United States Patent [19]

Leduc et al.

[11] Patent Number: 4,664,197

[45] Date of Patent: May 12, 1987

[54] FIRE EXTINGUISHING SYSTEM

[75] Inventors: Richard Leduc, Joliette; Virgilio D. Duarte, Westmount; Claude Lamothe, Laval, all of Canada

[73] Assignee: Chimney Guard Ltd./Garde Cheminee Ltee, Quebec, Canada

[21] Appl. No.: 821,254

[22] Filed: Jan. 22, 1986

[51] Int. Cl.[4] ..... A62C 37/30

[52] U.S. Cl. ..... 169/26; 169/57; 169/19; 169/DIG. 3

[58] Field of Search ..... 169/19, 26, 42, 54, 169/56, 57, 60, 65, DIG. 3

[56] References Cited

U.S. PATENT DOCUMENTS

| | | | |
|---|---|---|---|
| 2,519,350 | 8/1950 | Cahusac | 169/26 |
| 3,463,236 | 8/1969 | Flajole et al. | 169/26 X |
| 4,313,501 | 2/1982 | Eckert | 169/57 X |

FOREIGN PATENT DOCUMENTS

| | | | |
|---|---|---|---|
| 1161805 | 2/1984 | Canada | 169/DIG. 3 |

*Primary Examiner*—Andres Kashnikow

*Attorney, Agent, or Firm*—Oblon, Fisher, Spivak, McClelland & Maier

[57] ABSTRACT

A fire extinguishing system, particularly, but not exclusively, for use in extinguishing chimney fires. The system comprises a container having a pressurized fire extinguishing product therein. A release nozzle is installed in the chimney flue and has a conduit connecting it to a pressure release valve associated with the container. The valve is operated by a piston member which is connected by a wire cable to a fusible element which melts when the flue attains a predetermined temperature. A tension adjusting device is associated with the wire cable to adjust the tension in the cable and the position of a piston head relative to a trigger element associated with the pressure release valve.

11 Claims, 7 Drawing Figures

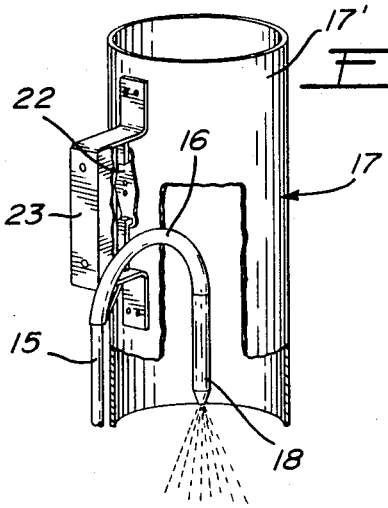
FIG. 2
FIG. 5
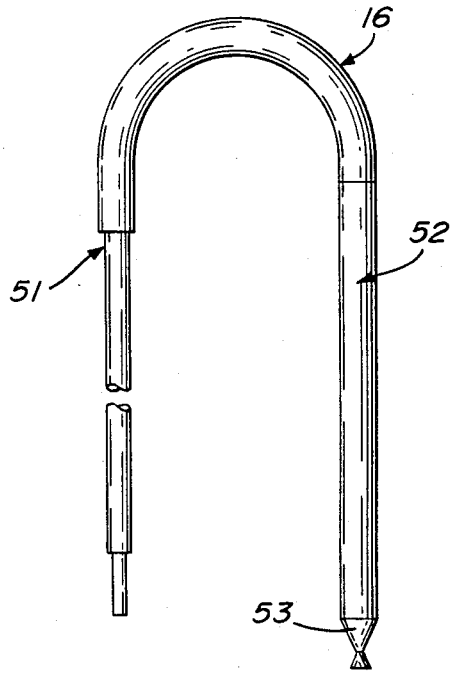
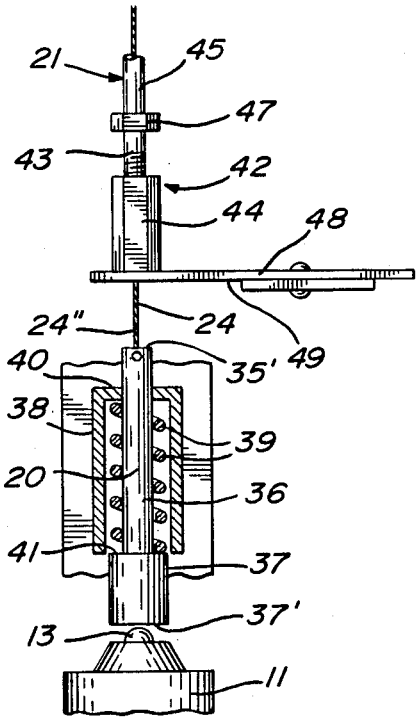
FIG. 6
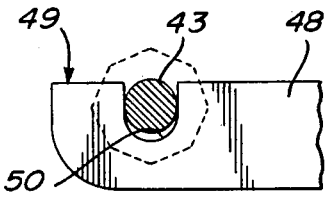
FIG. 7

FIRE EXTINGUISHING SYSTEM

BACKGROUND OF INVENTION

1. Field of Invention

The present invention relates to a fire extinguishing guishing system, particularly, but not exclusively, for use in extinguishing chimney fires and wherein a pressurized container is automatically activated by a piston member which is in turn operated by a temperature sensing device associated with a chimney flue.

2. Description of Prior Art

Various fire extinguishing systems and control apparatus are known for detecting fires in chimney flues. As an example thereof, reference is made to U.S. Pat. No. 2,024,316 issued Dec. 17, 1935 to W. Theissing which teaches a system wherein a fusible element extends internally and across the flue and, upon the occurrence of a fire, the fusible element will burn and eventually release a fire extinguishing substance within the flue. The use of fusible links are also known, such as taught by U.S. Pat. No. 3,448,808 issued on June 10, 1969 to Scofield et al. Reference is also made to Canadian Pat. No. 1,161,805 issued on Feb. 7, 1984 to S. Aderneck which teaches the mounting of a fusible element on a chimney flue with a combustible product release tube extending within the flue and connected to a pressurized container containing a fire extinguishing material. The present invention relates to an improvement of such fire extinguishing systems.

SUMMARY OF INVENTION

According to a feature of the present invention there is provided a fire extinguishing system for extinguishing chimney fires and wherein there is provided an improved release mechanism to activate the pressure control valve associated with a pressurized container whereby to release a fire extinguishing product in the chimney.

Another feature of the present invention is to provide an improved fire extinguishing system for extinguishing chimney fires and incorporating an improved fire extinguishing release nozzle locatable inside a chimney flue.

Another feature of the present invention is to provide an improved fire extinguishing system for extinguishing chimney fires and including an improved fusible link mounting assembly for detecting a fire condition in a chimney and releasing a fire extinguishing product therein.

Another feature of the present invention is to provide an improved fire extinguishing system for extinguishing chimney fires including an improved adjusting means to adjust the tension in a wire cable which connects a triggering piston member to a fusible element.

According to the above features, from a broad aspect, the present invention provides a fire extinguishing system comprising a container having a pressurized fire extinguishing product therein. A conduit is connected to the container and to a release nozzle. A pressure release valve is connected to the container and to the conduit to release the product in the conduit when the valve is opened. Valve control means is provided to operate the valve and includes a piston member. Link means connects the piston member to a fusible element. The fusible element is secured to an attachment bracket for locating the element in close proximity to a combustible product flue, so that the piston member will be activated upon the occurrence of a break of the fusible element when exceeding a predetermined temperature. Tension adjusting means is provided to adjust the tension of the link means and the position of the piston member. Disconnect means is provided to dismantle the adjusting means.

BRIEF DESCRIPTION OF DRAWINGS

A preferred embodiment of the present invention will now be described with reference to an example thereof as illustrated in the accompanying drawings, in which:

FIG. 2 is a perspective view, partly fragmented, illustrating the fusible element as mounted on a chimney flue together with the spray nozzle of the fire extinguishing conduit;

FIG. 5 is an enlarged view of the combustible product injector;

FIG. 6 is a fragmented section view showing the piston member and the tension adjusting means; and FIG. 7 is a fragmented end view of the lever.

DESCRIPTION OF PREFERRED EMBODIMENTS

Figure 1:
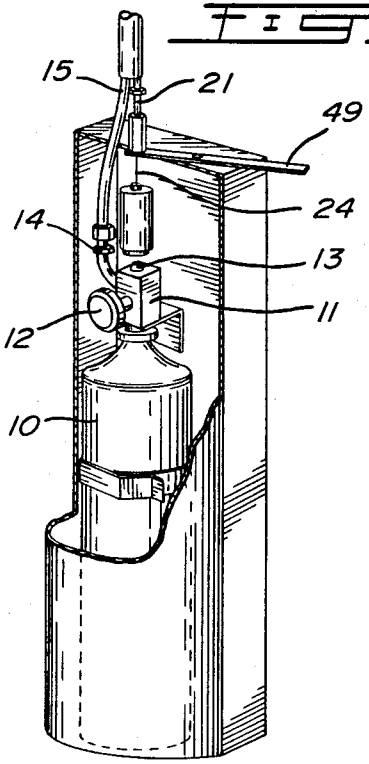
FIG. 1 is a perspective view of the pressurized container and a piston member associated with the tension adjusting means.

Referring now to the drawings, and more particularly to FIGS. 1 and 2, there is shown the fire extinguishing system of the present invention and comprising a pressurized container 10 having therein a fire extinguishing product, such as a liquid or powdered material. A pressure release valve 11 is secured to the neck of the container 10 and has a manually operable control 12 to place the valve 11 in a working condition. A trigger element 13 extends from a top wall of the valve 11 and when depressed displaces the obstruction member (not shown) to connect the outlet conduit 14 with the pressurized product inside the bottle. A flexible conduit 15 interconnects the outlet conduit 14 to an injector 16 secured to a chimney flue 17 with its nozzle end 18 disposed substantially centrally downward inside the flue.

A valve control means is connected adjacent the pressure release valve 11 and has a piston member 20 which is connected by a linkage 21 to a fusible element 22 which is secured adjacent the outer wall 17' of the flue 17 by an attachment bracket 23. When the fusible element 22 reaches a predetermined temperature it will break or become detached to release a wire 24 associated with the linkage 21 whereby to activate the piston member 20 which in turn pushes the trigger element 13 to cause the fire extinguishing product to flow in the conduit 15 and spray entirely inside the flue.

Figure 4:
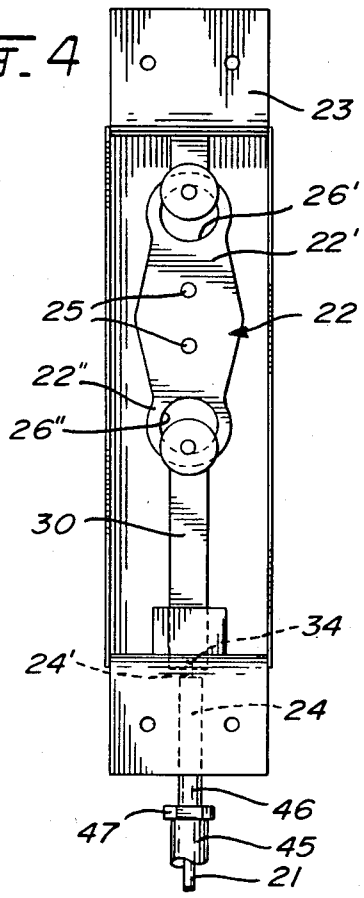
FIG. 4 is a front view of FIG. 3.
Figure 3:
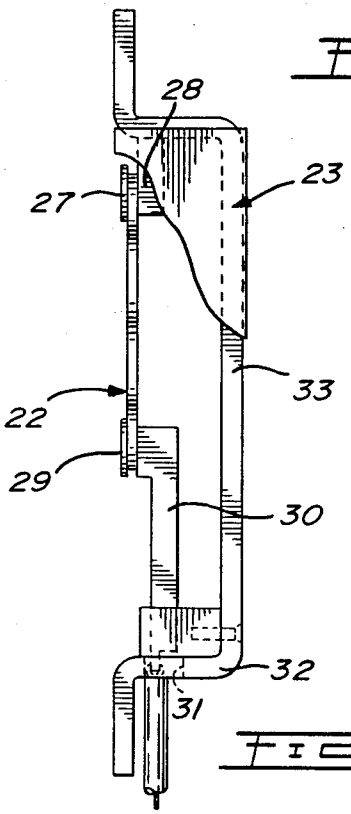
FIG. 3 is a side view of the fusible element and its attachment bracket.

Referring now to FIGS. 3 and 4, there is shown the construction of the fusible link element 22. As herein shown, the fusible link element is comprised of two juxtaposed plates 22' and 22'' which are interconnected by fusible solder spots which are meltable at a predetermined temperature. Instead of the solder spots 25, any other convenient soldering connection may be made, as the solder, upon reaching the predetermined temperature, will simply melt and release the interconnection of these plates. The end of these plates are provided with an eyelet 26' and 26'' with one of the eyelets receiving a pin-like connection 27 associated with a fixed connector 28 secured to the bracket 23. The other eyelet 26" receives a pin-like connection 29 associated with a floating link arm 30 which extends through a hole 31 in a bottom wall 32 of the bracket 23. As herein shown, the plates are maintained substantially parallel to the bracket attachment wall 33 and accordingly parallel to the outside wall 17' of the chimney flue. The bottom end of the floating link 30 is provided with an attachment hole 34 to secure the free end 24' of the cable 24 therein.

Referring now to FIG. 6, it can be seen that the other end 24" of the cable 24 is connected to a free end 35' of a piston rod 36 of the piston member 20. The opposite end of the piston rod 36 has a piston head 37. The piston shaft 36 is mounted in a piston housing 38 which houses a coil spring 39 about the shaft and compressed therein between a housing bottom wall 40 and a rear shoulder portion 41 of the piston head 37. The forward end 37' of the piston head is located a short distance above the trigger element 13 of the pressure release valve 11 and as soon as the piston 20 is released upon the break occurring in the fusible element, the spring pressure on the piston head will cause the head to move against the triggering element 13 to inject fire extinguishing material in the chimney via the conduit 15.

In order to adjust the position of the piston head 37 relative to the triggering element 13 and consequently the compression of the spring 39 and the tension in the cable 24, there is provided a tension adjustment means 42. This tension adjustment means consists of a threaded sleeve 43 having a threaded nut 44 threaded thereabout. The cable 24 passes freely within the sleeve 43. A protective flexible sheath 45 is retained at one end of the sleeve 43 and at its opposed end with a further sleeve 46 abutting the bottom end of the floating link 30. The ends of the sleeves 45 rest against respective abutting nuts 47.

As shown more clearly in FIGS. 1 and 6, the adjusting nut 44 rests on a support wall 48 which is herein constituted by the upper face of a pivoted lever 49. The lever 49 is provided with a throat portion 50 having a width sufficient to receive therethrough the sleeve member 43 but narrow enough to cause the adjustment nut 44 to abut the top wall 48 of the lever. By rotating the adjusting nut 44, tension in the cable 24 is either increased or decreased. Accordingly, the position of the piston head 37 relative to the trigger element 13 is adjusted as well as the tension within the coil spring 39. The spring 39 is compressed sufficiently to maintain the piston head against the triggering element 13 when released.

As hereinabove described, when the fusible element 22 breaks or becomes unsoldered, the cable 24 is released and accordingly the piston head is also released. To reinstall the system it is necessary to disengage the cable linkage 21, and this is effected by moving the lever 49 out of support engagement with the tension adjustment means 42 or nut 44. Accordingly, with no tension in the cable 24, it is now possible to replace the fusible element 22 and reconnect the floating link 30. Once the fusible element is reassembled, the sleeve 43 and adjustment nut 44 are again positioned within the throat 50 of the lever 49, as shown in FIGS. 6 and 7, and by rotating the nut 44, the piston head 37 is readjusted at the proper spacing above the triggering element 13. Thus, the pivoted support lever 49 constitutes a simple mechanical disconnect means to remove tension in the cable assembly.

Referring now to FIG. 5, there is shown the construction of the injector 16. As herein shown, the injector is a substantially elongated U-shaped member having a connecting arm section 51 and an injecting section 52. At least the injecting section 52 is formed of a heat-resistive material as it protrudes inside the flue 17 substantially centrally thereof. The free end of the injection section 52 is provided with a spray nozzle 53 whereby to release a spray of the fire extinguishing product within the flue. It is important to release the spray whereby to cover substantially all of the cross-sectional areas of the chimney thereby choking the fire by ensuring that the fire extinguishing product extends across the inner walls of the flue and into the combustion chamber (not shown) at the bottom of the flue. The connecting section 51 is conveniently secured to the attachment bracket 23 by any suitable means well known in the art.

It is within the ambit of the present invention to cover any obvious modifications of the example of the preferred embodiment described herein, provided such modifications fall within the scope of the appended claims. It is also pointed out that the fire extinguishing system of the present invention not be restricted to a chimney flue for slow combustion furnaces and that by modifying the injector portion thereof it could be adpated to any suitable device where it is necessary to extinguish a fire by releasing a fire extinguishing material therein when the device overheats. For example, it could be adapted to a hot consumable product dispensing machine such as a frying device.

We claim:

1. A fire extinguishing system comprising a container having a pressurized fluid associated with said container, a fire extinguishing product therein, a conduit connected to said container and to a release nozzle, a pressure release valve connected to said container and conduit to release said product in said conduit by said pressurized fluid when said valve is open, valve control means to operate said valve and including a piston member, link means connecting said piston member to a fusible element, said fusible element being secured to an attachment bracket for locating said fusible element in close proximity to a combustible product flue so that said piston member will be activated upon the occurrence of a break of said fusible element when exceeding a predetermined temperature, tension adjusting means to adjust the tension of said link means and the position of said piston member and a pivoted support lever having a support wall for support abutment of said adjusting means whereby to remove said tension and disconnect said adjustment means.

2. A fire extinguishing system as claimed in claim 1 wherein said tension adjusting means is a threaded sleeve secured to an end of said link means and having a nut threaded threabout, said sleeve being received in a throat portion formed in said support wall of said lever whereby said nut will rest on shoulder portions of said support wall adjacent said throat.

3. A fire extinguishing system as claimed in claim 2 wherein said link means is a cable having an outer protective sheath thereabout, said cable being freely displaceable in said sheath, said sheath being in immovable contact with said sleeve.

4. A fire extinguishing system as claimed in claim 1 wherein said piston member comprises a piston element having a shaft and a piston head, said shaft being connected at a connecting end opposite to said piston head to said link means, a piston housing immovably secured and containing at least said shaft therein, and biasing means about said shaft urging said piston head and shaft outwardly of said housing, said head being located adjacent a trigger element associated with said pressure release valve whereby to release said extinguishing product in said conduit when depressed by said piston head.

5. A fire extinguishing system as claimed in claim 4 wherein said biasing means is a coil spring positioned about said piston shaft in said piston housing and compressed between said piston head and a back wall of said housing, said piston rod extending outside said back wall and connected to a cable constituting said link means.

6. A fire extinguishing system as claimed in claim 5 wherein said tension adjusting means is a threaded sleeve secured to an end of said link means and having a nut threaded thereabout, said sleeve being received in a throat portion formed in said support wall of said lever whereby said nut will rest on shoulder portions of said support wall adjacent said throat.

7. A fire extinguishing system as claimed in claim 6 wherein the distance between said piston head and trigger element and hence, the tension in said coil spring, is adjustable by the position of said nut about said threaded sleeve.

8. A fire extinguishing system as claimed in claim 1 wherein said flue is a chimney flue associated with a combustion chamber, said conduit being connected to a chimney injector end section having a deflection nozzle disposable substantially at the center of said flue to release a spray of said pressurized fire extinguishing product substantially throughout the flue section below said nozzle.

9. A fire extinguishing system as claimed in claim 8 wherein said fusible element is comprised of two juxtaposed plates interconnected by a fusible solder meltable at said predetermined temperature, one of said plates being secured at one end to said attachment bracket, the other of said plates being connected to a floating link arm secured to said link means.

10. A fire extinguishing system as claimed in claim 9 wherein said plates extend substantially parallel to an outside wall of said flue, each said plates having an eyelet in a free end thereof, said eyelet receiving a pin-like connection therethrough, said link arm being maintained under tension by said piston member whereby to retain said fusible element taut between said connections.

11. A fire extinguishing system as claimed in claim 9 wherein said link means is a wire cable interconnected between said fusible element floating link and said piston member.

* * * * *